US009797602B2

(12) United States Patent
Holtdirk

(10) Patent No.: US 9,797,602 B2
(45) Date of Patent: Oct. 24, 2017

(54) HOUSEHOLD APPLIANCE AND METHOD FOR PRODUCING VENTILATION DEVICES

(71) Applicant: MIELE & CIE. KG, Guetersloh (DE)

(72) Inventor: Hans-Gerd Holtdirk, Lippstadt (DE)

(73) Assignee: MIELE & CIE. KG, Guetersloh (DE)

( * ) Notice: Subject to any disclaimer, the term of this patent is extended or adjusted under 35 U.S.C. 154(b) by 344 days.

(21) Appl. No.: 14/564,130

(22) Filed: Dec. 9, 2014

(65) Prior Publication Data

US 2015/0159883 A1 Jun. 11, 2015

(30) Foreign Application Priority Data

Dec. 10, 2013 (DE) ..... 10 2013 113 762

(51) Int. Cl.
*F24C 15/04* (2006.01)
*F24C 15/00* (2006.01)
*F24C 15/08* (2006.01)

(52) U.S. Cl.
CPC ..... *F24C 15/006* (2013.01); *F24C 15/08* (2013.01)

(58) Field of Classification Search
CPC .... F24C 15/006; F24C 15/08; F24C 15/2007; F24C 15/32; F24C 15/001; F24C 15/04; F24C 1/00; F24C 1/02; F24C 3/082; F24C 7/081; F24C 15/34; F24C 3/00; F24C 3/122; A21B 1/26; A21B 1/245; A21B 1/44; A21B 1/48; A21B 1/24; A21B 2/00; A21B 3/04; F24F 7/10; F24F 11/0001; F24F 11/022; F24F 11/04; F24F 13/00; F24F 13/20; F24F 7/007; A47L 7/04; A47L 11/4097; A47L 9/0081
See application file for complete search history.

(56) References Cited

FOREIGN PATENT DOCUMENTS

JP 2010281524 A * 12/2010

* cited by examiner

*Primary Examiner* — Jason Lau
(74) *Attorney, Agent, or Firm* — Leydig, Voit & Mayer, Ltd.

(57) ABSTRACT

A household appliance having at least one housing device having at least one housing part. The housing part includes at least one ventilation device having at least one ventilation opening. The ventilation opening includes at least one bulged-out wall portion and at least one bent-out wall portion. The bulged-out wall portion and the bent-out wall portion are configured and arranged relative to each other such that the view through the ventilation opening perpendicular to the housing part is substantially completely blocked.

6 Claims, 3 Drawing Sheets

HOUSEHOLD APPLIANCE AND METHOD FOR PRODUCING VENTILATION DEVICES

CROSS-REFERENCE TO RELATED APPLICATIONS

Priority is claimed to German Patent Application No. DE 10 2013 113 762.8, filed on Dec. 10, 2013, the entire disclosure of which is hereby incorporated by reference herein.

FIELD

The present invention relates to a household appliance including at least one housing device having at least one housing part. The housing part includes at least one ventilation device having at least one ventilation opening. The present invention further relates to a method for producing at least one ventilation device of this kind on at least one housing part of a housing device of a household appliance.

BACKGROUND

Household appliances generally include a housing with which is associated at least one functional region. For example, a household appliance in the form of a cooking appliance may have associated therewith, for example, a cooking chamber and/or a cooking zone for preparing food.

Also disposed in the housing are the electronic components necessary for operating the household appliance, such as, for example, components for supplying energy and/or for operating and/or controlling the household appliance.

Typically, heat is generated inside the household appliance during operation thereof Therefore, to ensure reliable operation, it may be advantageous to avoid excessive heating of the interior of the appliance and/or to cool the interior of the appliance. Cooling and/or dissipation of heat is advantageous, in particular, for the electronic components and/or for the region in which the electronic components are located.

Such cooling may be active or passive. Among other things, it may be sufficient merely to provide an outer sheet metal housing panel with openings preventing heat accumulation inside the appliance. In addition, one or more fans may be advantageously used to allow the heat that is generated during operation to be removed from the housing of the household appliance. Other active cooling methods may also be advantageously used, depending on the household appliance.

Such openings for ventilating the interior of the appliance are frequently configured as so-called "ventilation gills". For this purpose, for example, a cut is initially made in an outer sheet metal housing panel at a predetermined location. Then, the housing panel is slightly deformed at this location in order to provide a sufficiently large opening for ventilation of the interior of the appliance.

Such openings in the outer panels of a household appliance have the disadvantage that a user may, in certain circumstances, be able to look inside the appliance or housing. This is not particularly advantageous in terms of visual appearance on the one hand, and on the other hand, some countries have regulations that do not permit an unobstructed view of the interior of the housing.

Therefore, in order to prevent viewing of the interior of the appliance, it is common to provide additional view-obstructing panels which are mounted inside the appliance behind the openings in the exterior appliance wall.

Such additional view-obstructing panels have the disadvantage that the additional panel may restrict the free exchange of air. Moreover, the additional view-obstructing panel implies increased expenditure for material, production and assembly, which means increased manufacturing costs.

SUMMARY

In an embodiment, the present invention relates to a household appliance comprising at least one housing device having at least one housing part. The housing part includes a ventilation device having a ventilation opening. The ventilation opening includes a bulged-out wall portion and a bent-out wall portion. The bulged-out wall portion and the bent-out wall portion are configured and arranged relative to each other such that a view through the ventilation opening perpendicular to the housing part is substantially completely blocked.

BRIEF DESCRIPTION OF THE DRAWINGS

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following.

DETAILED DESCRIPTION

Figure 1:
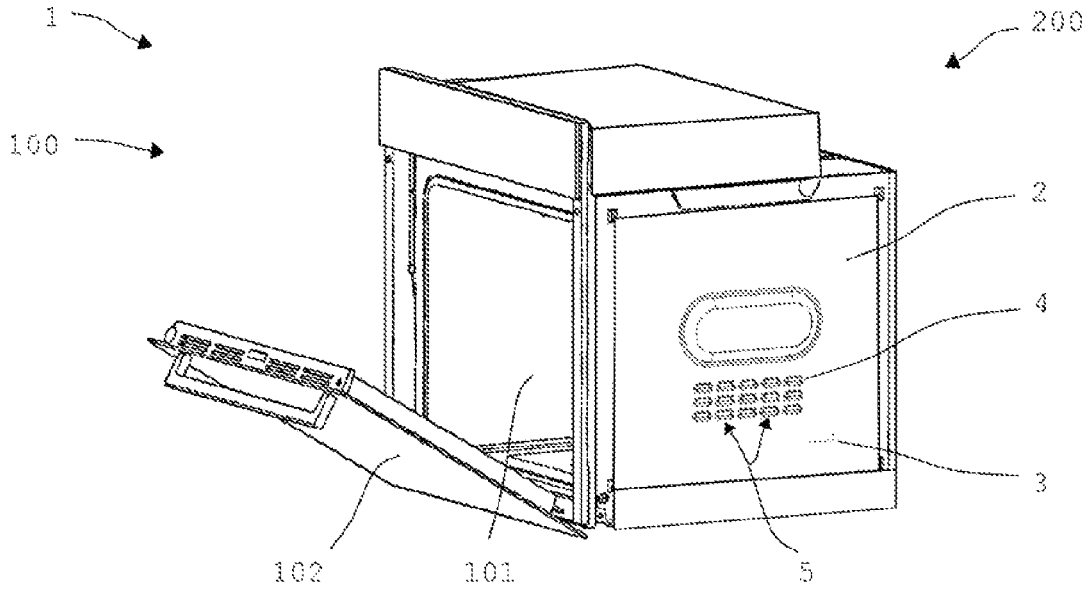
FIG. 1 is a perspective view showing a household appliance or a household appliance according to the present invention in a purely schematic representation.

An aspect of the present invention is to provide a household appliance having a ventilation device on a housing part of a housing device, and a method for manufacturing such a ventilation device on a housing part of a housing device, the ventilation device being simpler in construction while ensuring adequate ventilation without permitting viewing of the interior of the appliance.

The household appliance according to the present invention includes at least one housing device having at least one housing part. The housing part has at least one ventilation device, the ventilation device including at least one ventilation opening. The ventilation opening includes at least one bulged-out wall portion and at least one bent-out wall portion. In particular, the ventilation opening is bounded by the bulged-out wall portion and the bent-out wall portion. Furthermore, the bulged-out wall portion and the bent-out wall portion are configured and arranged relative to each other such that the view through the ventilation opening perpendicular to the housing part is substantially completely blocked. In this connection, the view through the ventilation opening, for example, into the interior of the housing, which is covered by the housing part, is at least partially and in particular completely blocked. To achieve this, the bulged-out wall portion and the bent-out wall portion are preferably disposed adjacent, i.e., opposite, each other.

The household appliance according to the present invention offers many advantages. One significant advantage is that, due to the inventive configuration of the ventilation opening of the ventilation device, a so-called "ventilation gill" having a ventilation slot is provided which serves, for example, to ventilate the interior of the housing of a household appliance, and which prevents, in a simple and effective manner, viewing of the interior of the housing when looking perpendicularly at the respective housing part.

In the case of conventional ventilation openings or ventilation gills, there typically remains an open see-through region through which a user can look into the interior of the household appliance when looking perpendicularly at the housing part. This is, on the one hand, not desired and not very appealing visually. Moreover, viewing the interior of the housing is not permitted in certain countries.

In the U.S., for example, UL standards forbid such conventional ventilation gill designs. To prevent viewing of the interior of a household appliance in the case of conventional ventilation gills, typically an additional view-obstructing panel is mounted behind the ventilation gills in the interior of the housing. However, such a panel implies increased structural complexity and also increases the expenditure for material and assembly. Furthermore, the conventional ventilation gills, together with an additional view-obstructing panel, also reduce the ventilation of the interior of the housing, which may have to be compensated for by increasing the number of ventilation gills.

Due to the inventive configuration of the ventilation openings of the ventilation device, the household appliance according to the present invention overall provides a household appliance where ventilation of the interior of the housing is provided in a structurally simple and effective manner, making it possible, inter alia, to save costs.

Preferably, the edge of the bulged-out wall portion bounding the ventilation opening and the edge of the bent-out wall portion bounding the ventilation opening lie substantially in one plane when looking perpendicularly at the housing part. The aforementioned plane is in particular understood to be the plane that extends in the direction of view.

In preferred embodiments, the edge of the bulged-out wall portion bounding the ventilation opening and the edge of the bent-out wall portion bounding the ventilation opening may alternatively at least partially overlap or cover each other. Such a configuration makes it possible to sufficiently block the view through the ventilation opening perpendicular to the housing part, making it possible to effectively prevent viewing of the interior of the housing of the household appliance. Moreover, the bent-out and bulged-out wall portions of the ventilation opening provide a ventilation opening that ensures adequate ventilation of the interior of the housing of the household appliance.

Particularly preferably, the ventilation device is formed in one piece with the housing part. Such a configuration has the advantage that no additional components are needed, which would have to be suitably connected to the housing part. Integral manufacture of the ventilation device with the housing part may be accomplished, for example, by deep drawing. To this end, for example, a bulge is formed in the housing part by deep drawing. This bulge may then, for example, be divided into two parts, one part of the bulge then being bent back, providing a bent-out wall portion.

In advantageous embodiments, the bulged-out wall portion and/or the bent-out wall portion then have a smaller material thickness than the remainder of the housing part. The different wall thicknesses result, for example, from the manufacturing method used to form the bulge in the housing part. Deep drawing, for example, causes the material to be stretched at a predetermined position in the housing part, thereby locally increasing the surface area of the respective wall portion. This increase in surface area is associated with a decrease in the wall thickness of the housing part.

In advantageous embodiments, the bulged-out wall portion and the bent-out wall portion point in different, in particular opposite, directions. The enables the two wall portions to partially and in particular completely overlap each other, thereby providing a simple and effective protection against viewing of the interior of the housing of the household appliance.

In the installed condition of the housing part, the bulged-out wall portion preferably points outwardly and the bent-out wall portion is preferably directed toward the interior of the appliance. Such a configuration provides particularly effective protection against viewing.

It is generally advantageous if the housing part is configured as a sheet metal housing panel, and in particular as an exterior sheet metal housing panel. Thus, adequate air circulation can be ensured between the ambient air and the interior of the appliance.

In other advantageous embodiments, the ventilation opening is bounded at the top by the bulged-out wall portion and at the bottom by the bent-out wall portion. In particular, if the bulged-out wall portion bounds the upper region of the ventilation opening, a user is unable to view the interior of the appliance even when he or she is looking down from above.

Particularly preferably, the ventilation device is shaped like a gill. Gill-shaped ventilation devices have proven to be particularly effective and advantageous.

The method according to the present invention is suitable for producing at least one ventilation device on at least one housing part of at least one housing device of a household appliance. The method is defined by the following steps. Initially, at least one first formation is created in at least one first forming direction perpendicular to the plane of the housing part at at least one predetermined position. Subsequently, this first formation is divided into at least two sections. After that, at least one second formation is created on at least one of the at least two sections in at least one second forming direction substantially opposite to the first forming direction.

The first formation may be, in particular, a depression or bulge, which may be produced, for example, by deep drawing or other manufacturing methods. The method according to the present invention is used, in particular, for sheet metal housing panels. Particularly preferably, ventilation devices configured as ventilation gills are integrated into exterior sheet metal housing panels to provide effective ventilation of the interior of the appliance.

The method according to the present invention also offers many advantages. One significant advantage of the method according to the present invention is that it provides a simple, effective and inexpensive way of integrating reliable and effective ventilation devices into a housing part. In particular, the method of the present invention makes it possible to produce ventilation devices which, on the one hand, provide effective ventilation of the interior of the appliance and, on the other hand, prevent viewing of the interior of the appliance without having to install and mount additional view-obstructing panels behind the ventilation device in the interior of the appliance.

Preferably, the first formation is formed in the housing part by deep drawing. The deep drawing process produces, as it were, more material for covering the ventilation opening, the material being thinned by the deep drawing process at the location of the formation. Such an embodiment has the particular advantage that the ventilation device can be manufactured in one piece with the housing part by such a manufacturing method.

Particularly preferably, a convexity is formed as the first formation, the longitudinal cross section and/or the transverse cross section of the convexity being, in particular, substantially roundish or oval. In particular, substantially dome-shaped embodiments of the first formation are convenient and expedient to use.

In further preferred embodiments, the division of the first formation into at least two sections is accomplished by cutting, milling, sawing and/or lasering. It is particularly preferred to lose as little material as possible when dividing the first formation into at least two sections. In this way, the ventilation device can be particularly readily configured to serve also as a view-obstructing means making it impossible for a user to view the interior of appliance through the ventilation opening of the ventilation device.

In advantageous embodiments, the at least two sections of the first formation are substantially identical and/or equal in size. Particularly preferred are two sections which may be equal in shape, equal in size and/or equal in function.

In further preferred embodiments, the second formation on at least one of the two sections is formed by pressing and/or bending. This allows the bent-out wall portion to be produced by bending back one of the sections of the depression. It is preferred to perform such bending back in such a way that the cut edge of the bent-back wall portion is brought, in particular, behind the plane of the remainder of the housing part.

In all embodiments, it is preferred to coat the housing part after producing the ventilation device. Due to the subsequent coating, it is achieved that the coating is not damaged during the production of the ventilation device. A coating applied beforehand would otherwise possibly become too thin or burst or be damaged during deep drawing. Moreover, the cut location would be an uncoated region which could affect the durability of the household appliance.

In accordance with the present invention, "coating" means in particular that the housing part is covered with a material. The material may be applied, for example, by enameling, vapor deposition, sheathing or other suitable methods.

Further advantages and features of the present invention will become apparent from the exemplary embodiment that is explained in the following with reference to the enclosed figures.

In FIG. 1, a household appliance 1 according to the present invention is shown in a purely schematic perspective view. Household appliance 1 is configured as a cooking appliance 100, in particular, as a baking oven 200. Household appliance 1 has a treatment chamber 101, which can be closed by a door 102.

Treatment chamber 101 is designed as a cooking chamber 103 and can be used for cooking food. To this end, it is equipped with at least one heat source. To heat up the cooking chamber, it is possible to use, for example, an upper/lower heat source, a convection air heat source, a heating air heat source, gas operation and/or microwave operation.

Household appliance 1 includes a housing device 2 with which treatment chamber 101 is associated. At housing device 2, there can be seen a housing part 3, in which are provided a plurality of ventilation devices 4 arranged in three rows. Ventilation devices 4 ensure adequate circulation of air between the interior 10 of the appliance and the ambient air, thereby making it possible to prevent accumulation of heat during operation of the household appliance.

Figure 2:
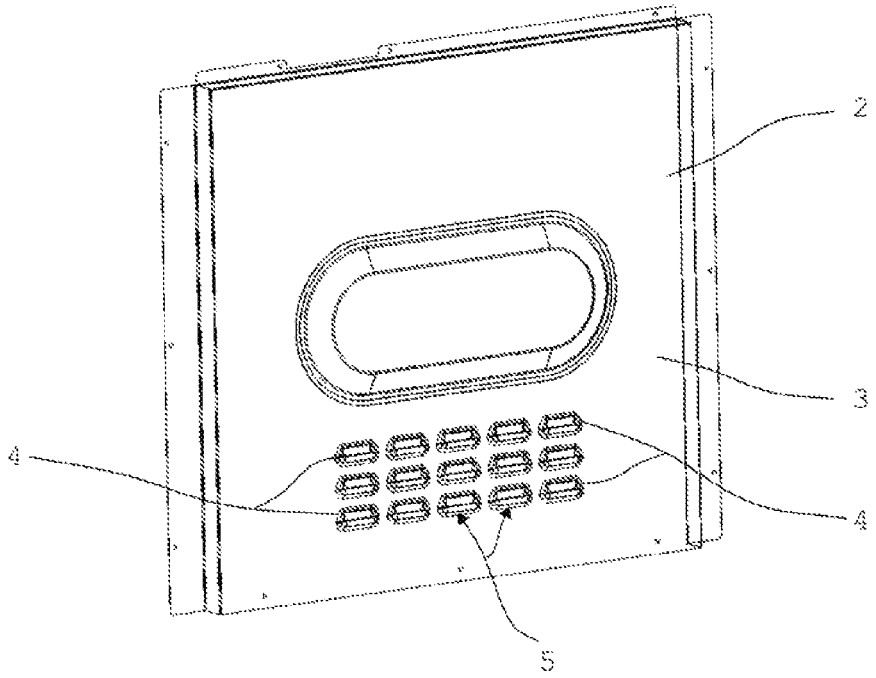
FIG. 2 is a purely schematic perspective view of the exterior side of a housing part having ventilation devices.

In FIG. 2, the exterior side of the housing part 3 of housing device 2 shown in FIG. 1 is shown in an uninstalled condition. In this enlarged view, it can again be seen that a total of fifteen ventilation devices are symmetrically arranged in three rows and five columns. Each of these ventilation devices 4 has a ventilation opening 5 to adequately ventilate the interior 10 of the appliance. Other numbers of ventilation devices, and other arrangements, in particular a different arrangement over the entire surface of housing part 3, may, of course, also be used advantageously, depending on the particular embodiment.

Figure 3:
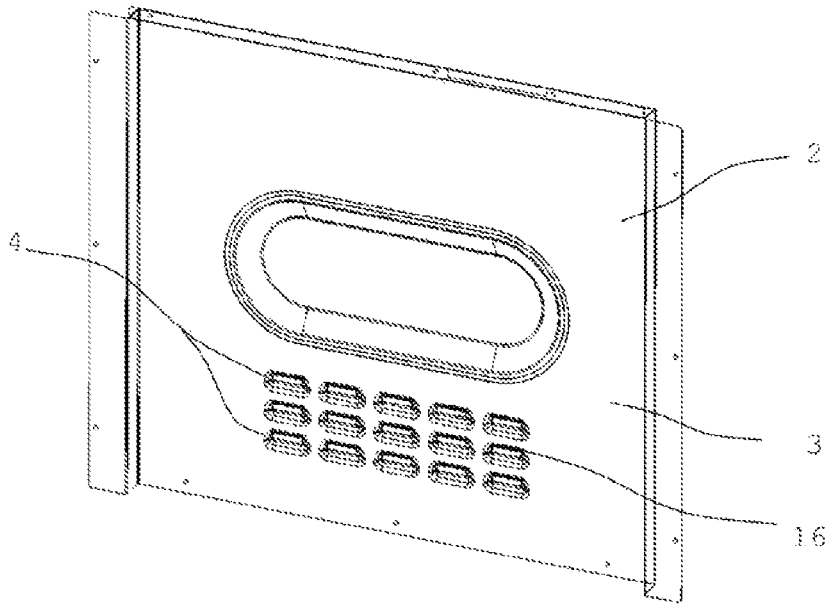
FIG. 3 is a purely schematic perspective view of the interior side of a housing part having ventilation devices.

The housing part 3 of housing device 2 of household appliance 1 shown in FIG. 2 is also shown in FIG. 3, which illustrates the interior side of the housing part. The plurality of ventilation devices 4, which each have a ventilation opening 5, can also be seen here. The view of the interior side of housing part 3 of housing device 2 clearly shows that ventilation devices 4 are not covered by any additional housing part on the interior side of housing part 3 either.

Figure 4:
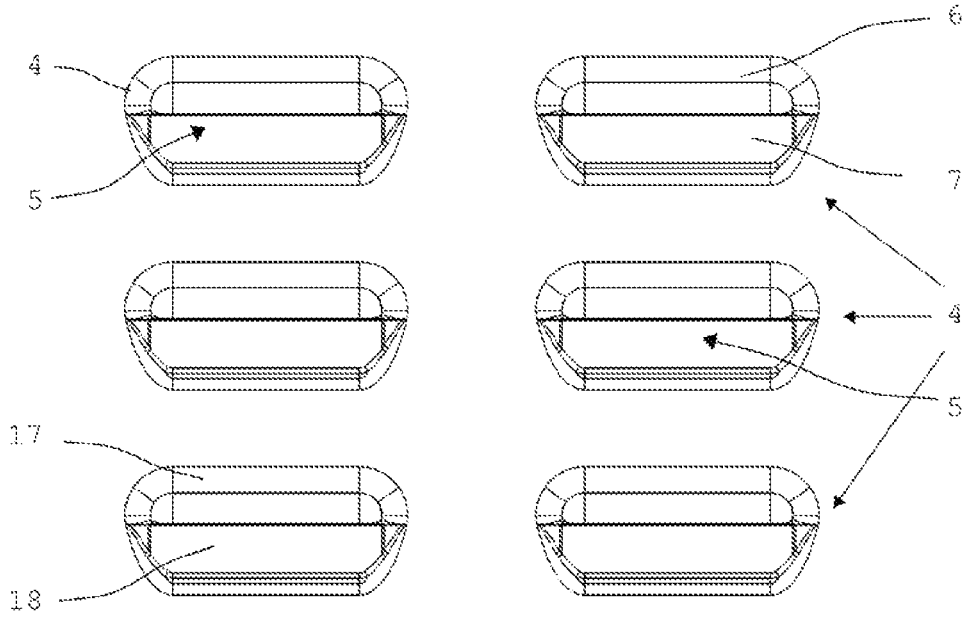
FIG. 4 is a purely schematic enlarged view of a plurality of ventilation devices.

In FIG. 4, ventilation devices 4 are shown purely schematically in an enlarged view. It is readily discernible that ventilation device 4 has two sections 17, 18 here, the upper section 17 being configured as a bulged-out wall portion 6 and the lower section 18 being configured as a bent-out wall portion 7. It can also be readily seen that when looking perpendicularly at ventilation devices 4, there remains no open region through which the interior 10 of the appliance could be viewed through ventilation openings 5 of ventilation devices 4.

Figure 5:
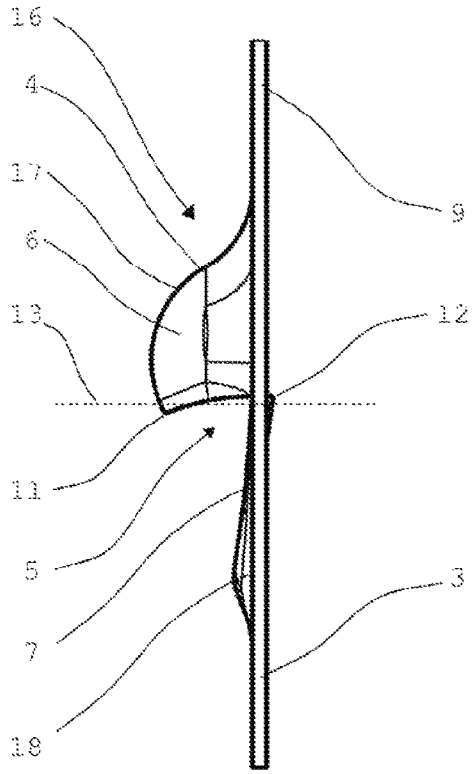
FIG. 5 is a purely schematic side view of a ventilation device.

In FIG. 5, housing part 3 of a housing device 2 of a household appliance 1 is shown purely schematically in a side view, the housing part 3 being an exterior sheet metal housing panel 9.

A ventilation device 4 is provided in housing part 3 at a predetermined position 16, the ventilation device having a ventilation opening 5 capable of ensuring adequate ventilation of the interior 10 of the appliance.

Ventilation device 4 includes an upper section 17 and a lower section 18, the upper section being configured as a bulged-out wall portion 6 and the lower section 18 being configured as a bent-out wall portion 7. As can be readily seen in FIG. 5, edge 11 of bulged-out wall portion 6 bounding ventilation opening 5 and edge 12 of bent-out wall portion 7 bounding the ventilation opening intersect the perpendicular viewing plane 13, thereby preventing viewing of the interior 10 of the appliance when looking perpendicularly at housing part 3.

By arranging bulged-out wall portion 6 and bent-out wall portion 7 relative to each other in this manner, viewing plane 13 is covered in such a way that it is impossible to view the interior of the appliance when looking in a perpendicular direction and when looking from above, even without providing additional housing parts such as are frequently used as a view-obstructing means in conventional ventilation devices.

Figure 6:
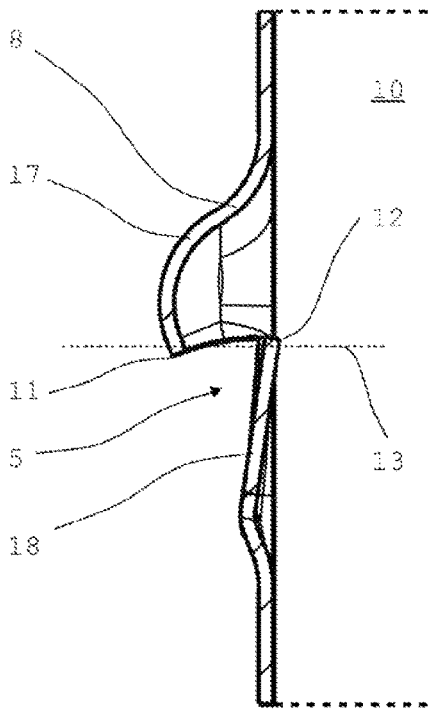
FIG. 6 is a cross-sectional view corresponding to FIG. 5.

FIG. 6 is a schematic cross-sectional view corresponding to the view of FIG. 5. Here, too, it can be readily seen that lower edge 11 of bulged-out wall portion 6 and upper edge 12 of bent-out wall portion 7 are arranged in slightly overlapping relationship with respect to one another. In other embodiments, upper edge 12 of the bent-out wall portion and lower edge 11 of the bulged-out wall portion may also terminate on the same plane. Such a configuration also effectively prevents viewing the interior 10 of the appliance.

Figure 7:
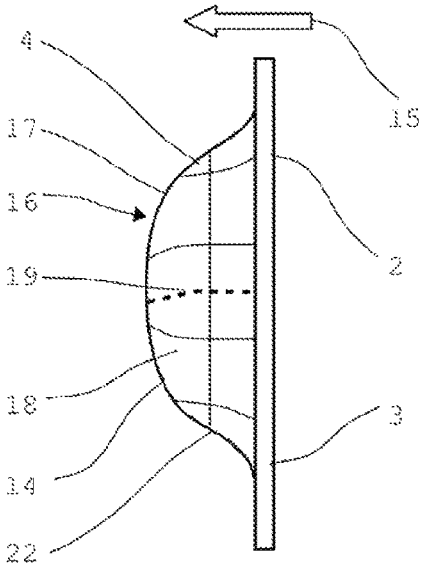
FIG. 7 is a purely schematic side view of a convexity in a housing part during the production of a ventilation device.
Figure 8:
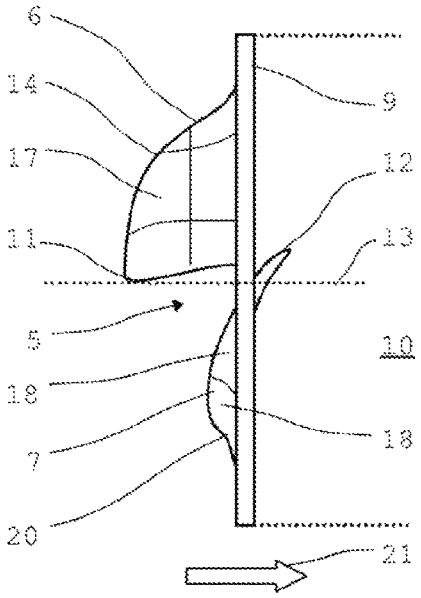
FIG. 8 is a purely schematic side view of a completed ventilation device.

FIGS. 7 and 8 illustrate the production of a ventilation device 4 according to the present invention purely schematically in a view from the side. Initially, a first formation 14 is made at a predetermined location 16 in a housing part 3 of a housing device 2 of a household appliance 1. In particular, when it is desired to produce ventilation device 4 in one piece with housing part 3, such a first formation 14 may be produced, in particular, by deep drawing. Thus, the thickness of housing part 3 in the region of first formation 14 may under certain circumstances at least partially become smaller than in the remainder of housing part 3.

First formation 14 is formed in a first forming direction 15, thereby creating a convexity 22. Such an in particular dome-shaped convexity 22 overall constitutes a bulged-out wall portion 6. In the exemplary embodiment shown here, convexity 22 is divided by a cut 19 into two sections 17 and 18 of substantially equal size.

In FIG. 8, it can be seen that upper section 17 remains as a bulged-out wall portion 6 and continues to extend in first forming direction 15.

As shown in FIG. 8, a second formation 20 is formed on lower section 18 of convexity 22 in a second forming direction 21 substantially opposite to first forming direction 15. Second formation 20 provides a bent-out wall portion 7 having an upper edge 12 which, in the exemplary embodiment shown here, intersects viewing plane 13 and cooperates with lower edge 11 of bulged-out wall portion 6 in such a manner that viewing the interior 10 of household appliance 1 is prevented, in particular when looking in a perpendicular direction.

In the exemplary embodiment shown here, second formation 20 is produced by bending back lower section 18 of convexity 22. However, other formations and methods for bending out bent-out wall portion 7 can also be suitably used.

In particular, if convexity 22 is produced using a deep drawing method, it is possible to provide a ventilation device 4 which prevents viewing of the interior 10 of the appliance through ventilation opening 5 of ventilation device 4 when looking in a perpendicular direction. This is because the deep drawing process produces a larger surface at predetermined location 16 of housing part 3; i.e., more material is available for forming a bulged-out wall portion 6 and a bent-out wall portion 7 to thereby create a ventilation opening 5 of ventilation device 4 which makes it impossible for a user to view therethrough when looking perpendicularly at housing part 3.

This is independent of the manner in which cut 19 is made through convexity 22; i.e., through first formation 14. Such a cut 19 may be made, for example, by a cutting operation, by milling, by sawing, by lasering and/or by welding. As a result of such a cut 19, at least a small portion of material is lost, which would normally enable viewing the interior 10 of the appliance.

However, by producing a first formation 14 prior to a cutting operation for producing a cut 19, an amount of material is provided which, despite the cut 19 through first formation 14, is sufficient to form ventilation device 4 in a manner that makes it impossible to view the interior 10 of the appliance through ventilation opening 5.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

LIST OF REFERENCE NUMERALS

1 household appliance
2 housing device
3 housing part
4 ventilation device
5 ventilation opening
6 bulged-out wall portion
7 bent-out wall portion
8 material thickness
9 sheet metal housing panel
10 interior of the housing
11 bounding edge/lower edge
12 bounding edge/upper edge
13 plane
14 first formation
15 first forming direction
16 predetermined position
17 section
18 section
19 cut
20 second formation
21 second forming direction
22 convexity
100 cooking appliance
101 treatment chamber
102 door
103 cooking chamber
200 baking oven

What is claimed is:

1. A household appliance comprising:

at least one housing device having at least one housing part, the housing part including a ventilation device having a ventilation opening, wherein the ventilation opening includes a bulged-out wall portion and a bent-out wall portion, the bulged-out wall portion and the bent-out wall portion being configured and arranged relative to each other such that a view through the ventilation opening perpendicular to the housing part is substantially completely blocked, and wherein and edge of the bulged-out wall portion bounding the ventilation opening and an edge of the bent-out wall portion bounding the ventilation opening at least partially overlap each other when viewed perpendicularly at the housing part.

2. The household appliance as recited in claim 1, wherein the ventilation device is formed in one piece with the housing part.

3. The household appliance as recited in claim 1, wherein the bulged-out wall portion and the bent-out wall portion point in opposite directions.

4. The household appliance as recited in claim 3, wherein in an installed condition of the housing part, the bulged-out wall portion points outwardly and the bent-out wall portion is directed toward an interior of the appliance.

5. The household appliance as recited in claim 1, wherein the bulged-out wall portion bounds the ventilation opening at a top thereof and the bent-out wall portion bounds the ventilation opening at a bottom thereof.

6. The household appliance as recited in claim 1, wherein the ventilation device is shaped like a gill.

* * * * *